US006868837B2

(12) United States Patent
Ament

(10) Patent No.: US 6,868,837 B2
(45) Date of Patent: Mar. 22, 2005

(54) COLD START FUEL VAPOR ENRICHMENT

(75) Inventor: Frank Ament, Troy, MI (US)

(73) Assignee: General Motors Corporation, Detroit, MI (US)

( * ) Notice: Subject to any disclaimer, the term of this patent is extended or adjusted under 35 U.S.C. 154(b) by 10 days.

(21) Appl. No.: 10/383,783

(22) Filed: Mar. 7, 2003

(65) Prior Publication Data

US 2004/0173195 A1 Sep. 9, 2004

(51) Int. Cl.[7] ..... F02M 21/00

(52) U.S. Cl. ..... 123/520; 123/525; 123/698; 123/575; 123/491

(58) Field of Search ..... 123/520, 525, 123/698, 685, 491, 575, 576; 701/103, 113

(56) References Cited

U.S. PATENT DOCUMENTS 5,111,796 A * 5/1992 Ogita ..... 123/520
5,329,914 A * 7/1994 Togai et al. ..... 123/688
5,483,935 A * 1/1996 Ogawa et al. ..... 123/406.47
5,781,875 A * 7/1998 Maki et al. ..... 701/104
5,875,765 A * 3/1999 Norton ..... 123/520
6,176,222 B1 * 1/2001 Kirwan et al. ..... 123/492
6,234,153 B1 5/2001 DeGroot et al. ..... 123/525
6,494,192 B1 * 12/2002 Capshaw et al. ..... 123/576
2001/0003977 A1 * 6/2001 Hayashi et al. ..... 123/480
2004/0040540 A1 * 3/2004 Blakley ..... 123/430

* cited by examiner

*Primary Examiner*—Hai Huynh
(74) *Attorney, Agent, or Firm*—Christopher DeVries

(57) ABSTRACT

An engine system includes an engine, a fuel system that communicates with the engine, and a controller that communicates with the fuel system. The controller controls a first quantity of liquid fuel to the engine at a first A/F ratio and a second quantity of vapor fuel to the engine at a second A/F ratio during a predetermined period after start-up. The liquid and vapor fuel mixture has a third A/F ratio. The controller determines an available A/F ratio of vapor fuel within the fuel tank and performs a comparison with a target A/F ratio range. The second quantity is set to zero if the A/F ratio of the vapor fuel is outside of the target A/F ratio range. The controller adjusts the first and second quantities based on a comparison between an exhaust A/F ratio and a target exhaust A/F ratio.

28 Claims, 4 Drawing Sheets

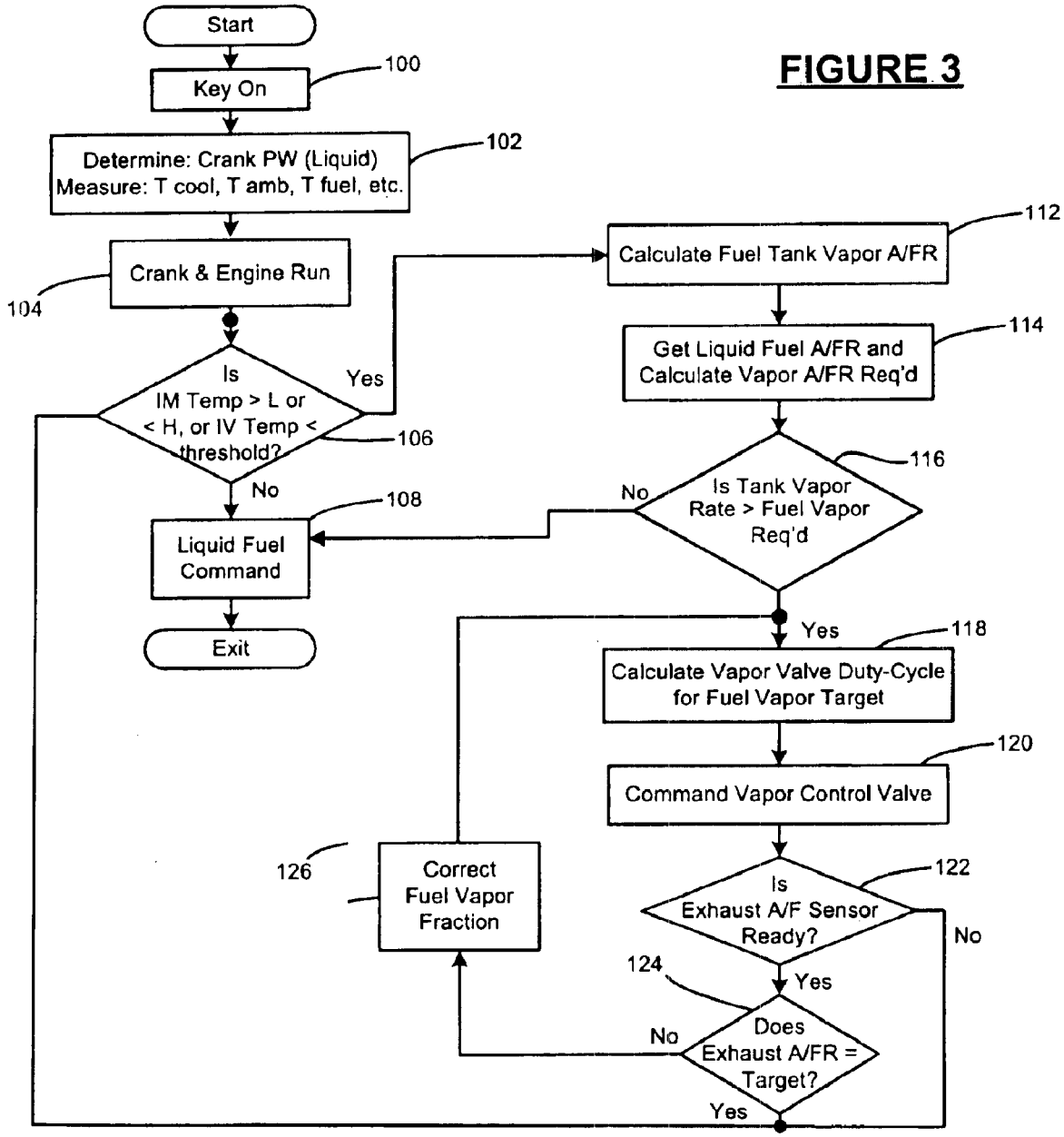
FIGURE 3
Start
Key On
100
Determine: Crank PW (Liquid)
Measure: T cool, T amb, T fuel, etc.
102
Crank & Engine Run
104
Is
IM Temp > L or
< H, or IV Temp <
threshold?
106
Yes
No
Liquid Fuel
Command
108
Exit
Calculate Fuel Tank Vapor A/FR
112
Get Liquid Fuel A/FR and
Calculate Vapor A/FR Req'd
114
Is Tank Vapor
Rate > Fuel Vapor
Req'd
116
No
Yes
Calculate Vapor Valve Duty-Cycle
for Fuel Vapor Target
118
Command Vapor Control Valve
120
Is
Exhaust A/F Sensor
Ready?
122
No
Yes
Does
Exhaust A/FR =
Target?
124
No
Yes
Correct
Fuel Vapor
Fraction
126

COLD START FUEL VAPOR ENRICHMENT

FIELD OF THE INVENTION

The present invention relates to engine control systems, and more particularly to engine control systems that provide vapor enrichment of fuel flowing to an engine during cold start conditions.

BACKGROUND OF THE INVENTION

During combustion, an internal combustion engine oxidizes gasoline and combines hydrogen ($H_2$) and carbon (C) with air. Combustion creates chemical compounds such as carbon dioxide ($CO_2$), water ($H_2O$), carbon monoxide (CO), nitrogen oxides ($NO_x$), unburned hydrocarbons (HC), sulfur oxides ($SO_x$), and other compounds. During an initial startup period after a long soak, the engine is still "cold" after starting and combustion of the gasoline is incomplete. A catalytic converter treats exhaust gases from the engine. During the startup period, the catalytic converter is also "cold" and does not operate optimally.

In one conventional approach, an engine controller commands a lean air/fuel (A/F) ratio and supplies a reduced mass of liquid fuel to the engine to provide compensation. More air is available relative to the mass of liquid fuel to sufficiently oxidize the CO and HC. However, the lean condition reduces engine stability and adversely impacts vehicle drivability.

In another conventional approach, the engine controller commands a fuel-rich mixture for stable combustion and good vehicle drivability. A secondary air injection system provides an overall lean exhaust A/F ratio. The secondary air injector injects air into the exhaust stream during the initial start-up period. The additional injected air heats the catalytic converter by oxidizing the excess CO and HC. The warmed catalytic converter oxidizes CO and HC and reduces $NO_x$ to lower emissions levels. However, the secondary air injection system increases cost and complexity of the engine control system and is only used during a short initial cold start period.

SUMMARY OF THE INVENTION

An engine system according to the present invention includes an engine, a fuel system that communicates with the engine, and a controller that communicates with the fuel system. The controller controls a first quantity of liquid fuel to the engine at a first A/F ratio and a second quantity of vapor fuel to the engine at a second A/F ratio during a predetermined period after start-up. The liquid and vapor fuel provide a fuel mixture having a third A/F ratio.

In other features, the controller adjusts the first and second quantities based on a temperature of the engine. The second quantity is zero if the engine temperature is outside of a specified temperature range. The controller controls an initial A/F ratio of liquid fuel supplied to the engine during start-up and estimates the third A/F ratio based thereon.

In yet other features, the controller determines an available A/F ratio of vapor fuel within the fuel tank and performs a comparison with a target A/F ratio range. The second quantity is set to zero if the A/F ratio of the vapor fuel is outside of the target A/F ratio range.

In still other features, the controller receives an exhaust A/F ratio from an exhaust A/F ratio sensor and compares the exhaust A/F ratio to a target A/F ratio range. The controller adjusts the first and second quantities if the exhaust A/F ratio is outside of the target A/F ratio range.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 is a flowchart showing steps of a cold start fuel vapor enrichment control method according to the present invention.

DETAILED DESCRIPTION OF THE PREFERRED EMBODIMENTS

Figure 1:
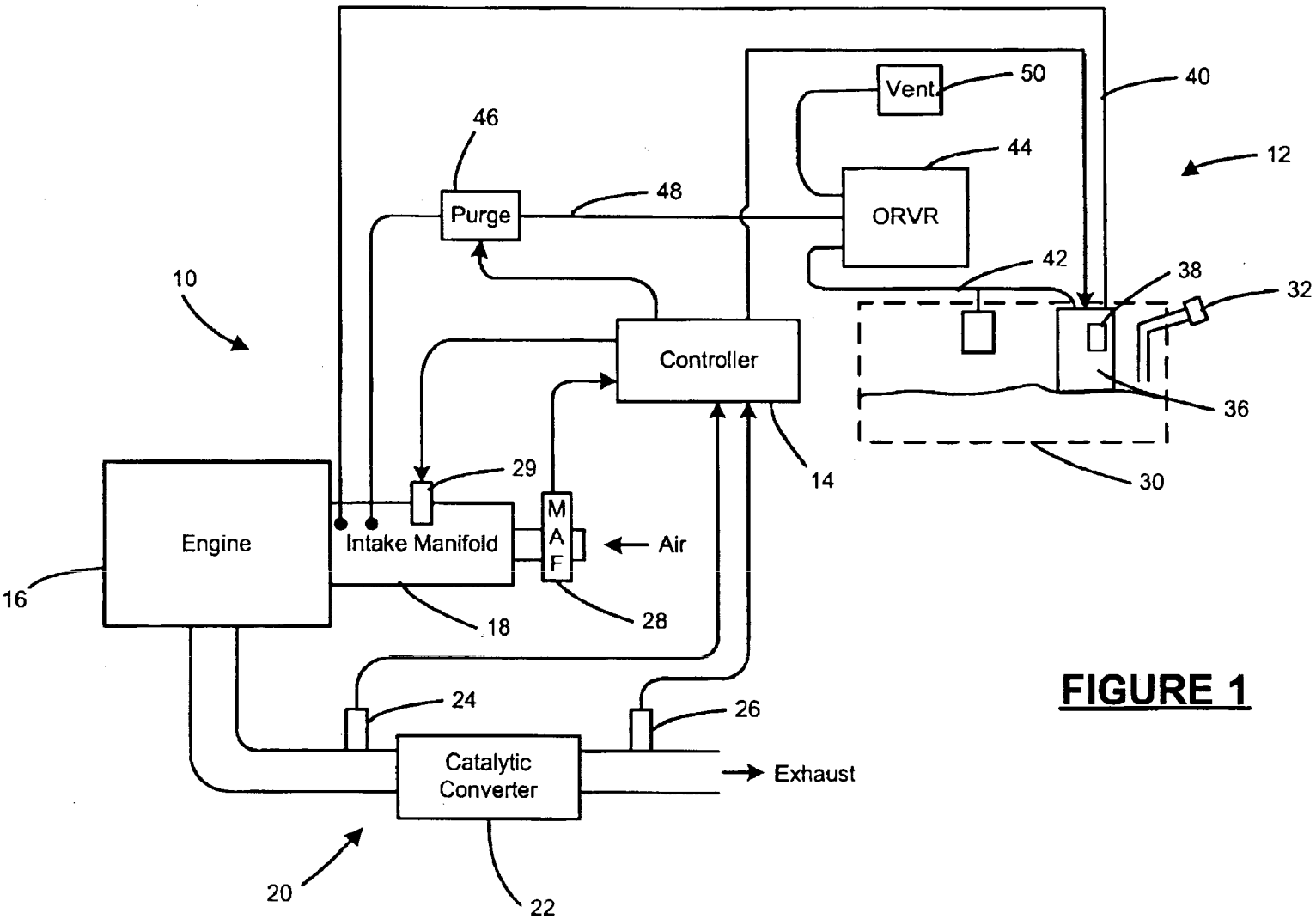
FIG. 1 is a functional block diagram of an engine control system and a fuel system.

The following description of the preferred embodiment is merely exemplary in nature and is in no way intended to limit the invention, its application, or uses. For purposes of clarity, the same reference numbers will be used in the drawings to identify similar elements.

Referring to FIG. 1, an engine system 10 and a fuel system 12 are shown. One or more controllers 14 communicate with the engine and fuel systems 10, 12. The fuel system 12 selectively supplies liquid and/or vapor fuel to the engine system 10, as will be described in further detail below.

The engine system 10 includes an engine 16, an intake manifold 18, and an exhaust 20. Air and fuel are drawn into the engine 16 and combusted therein. Exhaust gases flow through the exhaust 20 and are treated in a catalytic converter 22. First and second $O_2$ sensors 24 and 26 communicate with the controller 14 and provide exhaust A/F ratio signals to the controller 14. A mass air flow (MAF) sensor 28 is located within an air inlet and provides a mass air flow (MAF) signal based on the mass of air flowing into the intake manifold 18. The controller 14 uses the MAF signal to determine the A/F ratio supplied to the engine 16. An intake manifold temperature sensor 29 generates an intake air temperature signal that is sent to the controller 14.

The fuel system 12 includes a fuel tank 30 that contains liquid fuel and fuel vapors. A fuel inlet 32 extends from the fuel tank 30 to allow fuel filling. A fuel cap 34 closes the fuel inlet 32 and may include a bleed hole (not shown). A modular reservoir assembly (MRA) 36 is disposed within the fuel tank 30 and includes a fuel pump 38. The MRA 36 includes a liquid fuel line 40 and a vapor fuel line 42.

The fuel pump 38 pumps liquid fuel through the liquid fuel line 40 to the engine 16. Vapor fuel flows through the vapor fuel line 42 into an on-board refueling vapor recovery (ORVR) canister 44. A vapor fuel line 48 connects a purge solenoid valve 46 to the ORVR canister 44. The controller 14 modulates the purge solenoid valve 46 to selectively enable vapor fuel flow to the engine 16. The controller 14 modulates a canister vent solenoid valve 50 to selectively enable air flow from atmosphere into the ORVR canister 44.

Figure 2:
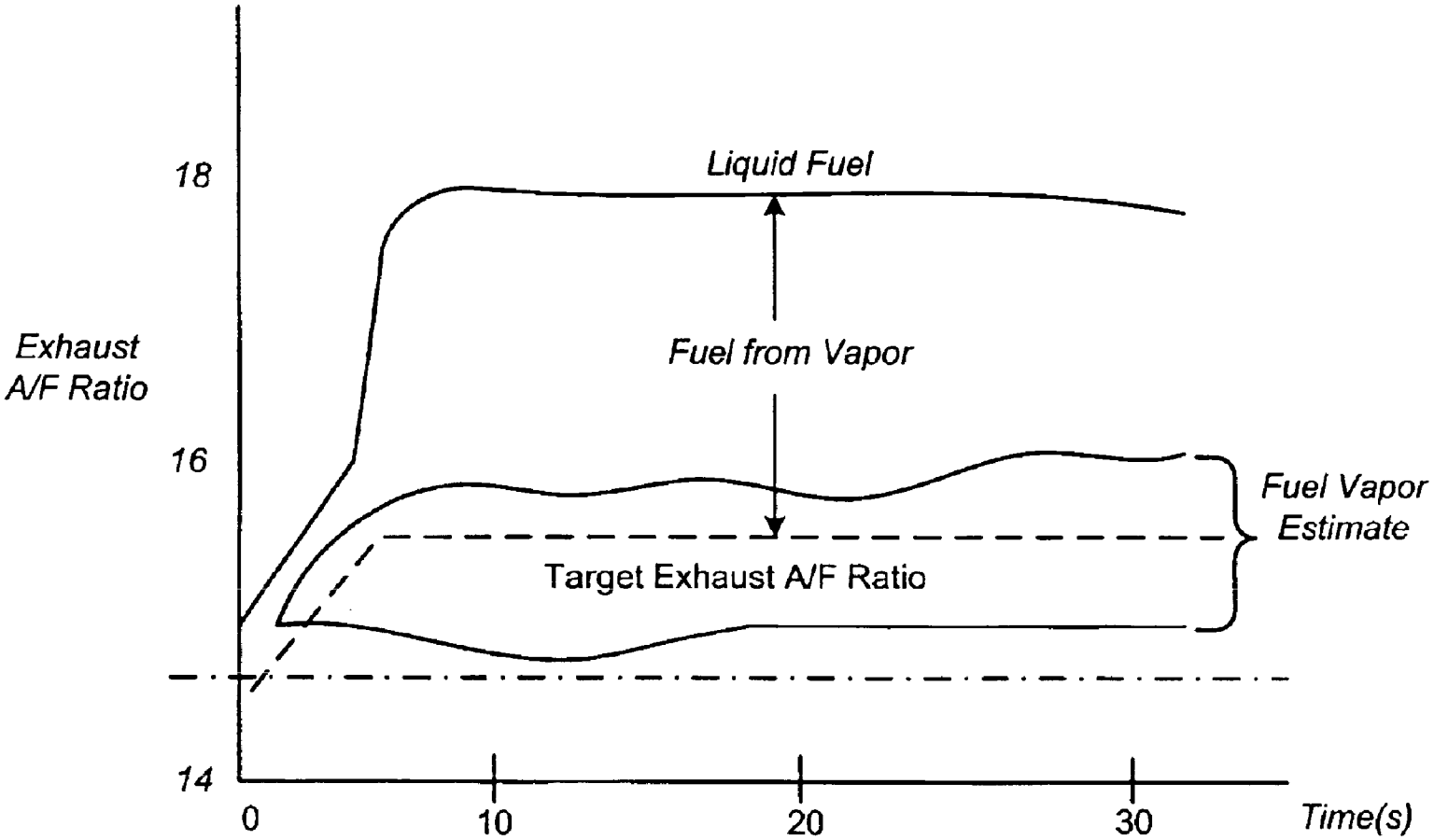
FIG. 2 is a graph illustrating a liquid fuel A/F ratio and a vapor fuel A/F ratio according to the present invention.

Referring to FIGS. 2 and 3, a cold start fuel vapor enrichment control method will be described in further detail. In general, vapor fuel is used to supplement and enrich the A/F mixture during cold start of the engine 16. The vapor fuel within the fuel tank 30 retains a predictable A/F ratio between engine cold starts. The A/F ratio of the fuel can be estimated based on temperature and a Reid vapor pressure (RVP) rating of the fuel. In an exemplary manner, the RVP value of the fuel is estimated during closed loop, steady-state engine operation based on a hydrocarbon purge flow and the temperature of the fuel tank 30.

The vapor fuel is typically very rich. Therefore, a relatively small amount of vapor fuel is able to provide a significant portion of the fuel required to compensate the engine 16. Vapor fuel is present within the fuel tank 30 at atmospheric pressure. A sufficient amount of vapor fuel is usually available to handle throttle crowds and step-in maneuvers. As shown graphically in FIG. 2, fuel vapor having an A/F ratio within the designated range of approximately 2 to approximately 3, can be supplied in conjunction with liquid fuel having an A/F ratio of up to 18 or 20, to achieve a target exhaust A/F ratio of about 15.5.

As detailed in FIG. 3, after a key-on event occurs in step 100, the controller 14 determines the amount of liquid fuel required during engine crank (i.e. initial ignition). Currently available parameters including engine coolant temperature ($T_{COOL}$), ambient air temperature ($T_{AMB}$), and fuel temperature ($T_{FUEL}$) are measured in step 102. In step 104, the engine is cranked and initially runs and burns the liquid fuel having an initial A/F ratio. In step 106, the intake manifold temperature ($T_{IM}$) is measured and compared to a predetermined temperature range. If $T_{IM}$ falls outside of the temperature range, the controller 14 operates the engine using only liquid fuel in step 108. If $T_{IM}$ falls within the temperature range, the controller 14 initiates a vapor enrichment mode. In one embodiment, the predetermined temperature range is between approximately 30° F. and 85° F., although other temperature values may be used.

Alternatively, in step 106, intake valve temperature is estimated and compared to a threshold value. The intake valve temperature is estimated based on engine coolant temperature, engine speed, manifold absolute pressure (MAP), and an equivalence ratio. The equivalence ratio is defined as the stoichiometric A/F ratio divided by the actual A/F ratio. A predictive model for intake valve temperature is provided in "Intake-Valve Temperature and the Factors Affecting It", Alkidas, A. C., SAE Paper 971729, 1997, expressly incorporated herein by reference. If the intake valve temperature is greater than the threshold value, the controller 14 operates the engine using only liquid fuel in step 108. If the intake valve temperature is less than the threshold value, the controller 14 initiates the vapor enrichment mode. The threshold temperature is provided as 120° C., however, it is appreciated that the specific value of the threshold temperature may vary.

In the vapor enrichment mode, the A/F ratio of the vapor fuel within the fuel tank is estimated in step 112. In step 114, the present liquid fuel A/F ratio is determined and the target vapor fuel A/F ratio is calculated. The vapor fuel A/F ratio is compared to the target vapor fuel A/F ratio in step 116. If the vapor fuel A/F ratio is insufficient (i.e., greater than the target vapor fuel A/F ratio), control continues with step 108. If the vapor A/F ratio is sufficient (i.e., less than the target vapor fuel A/F ratio), control continues with step 118. In step 118, a duty-cycle for the purge solenoid valve 46 is calculated to achieve the appropriate flow of vapor fuel into the engine 16. In step 120, the controller 14 operates the vapor control valve at the calculated duty-cycle.

In step 122, the controller 14 determines whether the first $O_2$ sensor is ready to provide an exhaust A/F ratio measurement. If the first $O_2$ sensor is not ready, control loops back to step 106. If the first $O_2$ sensor is ready, the controller 14 continues with step 124 where a measured exhaust A/F ratio is compared to the target exhaust A/F ratio. If the exhaust A/F ratio is equal to the target exhaust A/F ratio, control loops back to step 106. However, if the exhaust A/F ratio is not equal to the target exhaust A/F ratio, control continues with step 126. In step 126, the vapor fuel supply is adjusted using the purge solenoid valve duty cycle in step 118.

Control continuously loops through the vapor enrichment mode until $T_{IM}$ achieves a temperature outside of the specified range. An end of the start-up period occurs when $T_{IM}$ is a sufficiently high temperature and control loops to step 108 to initiate normal operation of the engine.

Figure 4:
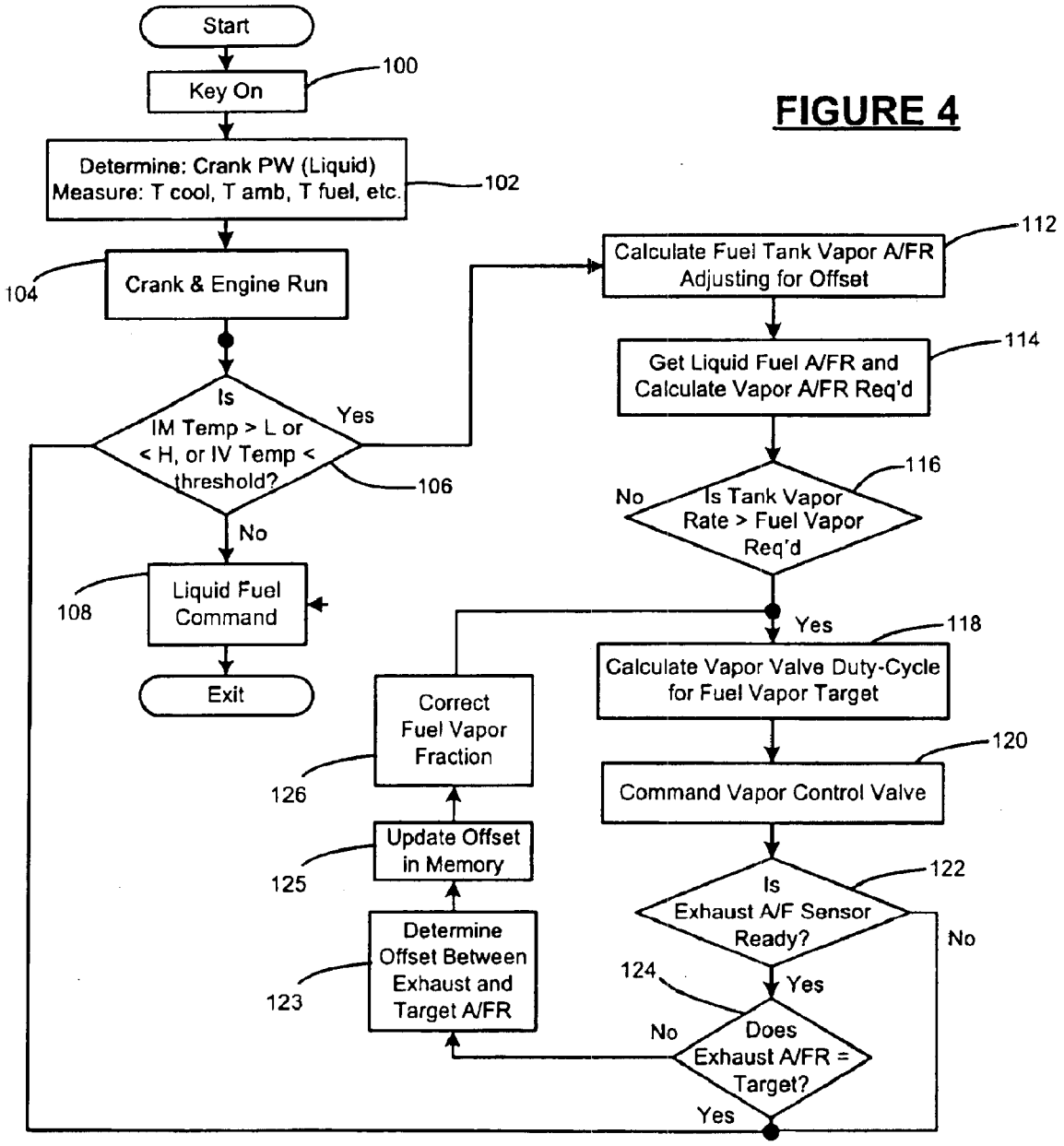
FIG. 4 is a flowchart showing steps of the cold start fuel vapor enrichment control method including determining an A/F ratio offset.

With reference to FIG. 4, the fuel tank vapor A/F ratio calculated in step 112 can be trimmed or corrected. In step 123, an offset is calculated as the difference between the exhaust A/F ratio and the target exhaust A/F ratio. The offset is updated in memory in step 125 as control loops through the vapor enrichment mode. Upon the next cold-start of the vehicle, calculation of the fuel tank vapor A/F ratio in step 112 takes into account the offset value stored in memory. This enables more accurate control of the A/F ratios. The offset value can be compared with the RVP estimate to further improve the vapor A/F ratio estimate.

The cold start fuel vapor enrichment control method of the present invention significantly reduces the liquid fuel required during cold start and warm up. Further, HC emissions are reduced and the engine is able to operate slightly lean of the stoichiometric A/F ratio to enable quick $O_2$ catalyst warm-up. Additionally, the control strategy of the present invention can be readily implemented in a traditional engine system with minimal hardware modification.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine system comprising:

an engine;

a fuel system that communicates with said engine; and a controller that communicates with said fuel system and that controls a first quantity of liquid fuel to said engine at a first A/F ratio and a second quantity of vapor fuel to said engine at a second A/F ratio to provide a fuel mixture having a third A/F ratio during a predetermined period after cold start-up.

2. The engine system of claim 1 wherein said controller adjusts said first and second quantities based on a temperature of said engine.

3. The engine system of claim 2 wherein said second quantity is zero if said engine temperature is outside of a specified temperature range.

4. The engine system of claim 2 wherein said engine temperature is an intake manifold temperature.

5. The engine system of claim 2 wherein said engine temperature is an intake valve temperature.

6. The engine system of claim 1 wherein said controller controls an initial A/F ratio of liquid fuel supplied to said engine during start-up and estimates said third A/F ratio based thereon.

7. The engine system of claim 6 wherein said controller adjusts said available A/F ratio based on an A/F ratio offset.

8. The engine system of claim 7 wherein said controller calculates an A/F ratio offset based on said exhaust A/F ratio and said target A/F ratio.

9. The engine system of claim 1 wherein said controller determines an available A/F ratio of vapor fuel within said fuel tank, performs a comparison with a target A/F ratio range, and wherein said second quantity is set to zero if said A/F ratio of said vapor fuel is outside of said target A/F ratio range.

10. The engine system of claim 1 wherein said controller receives an exhaust A/F ratio from an exhaust A/F ratio sensor, compares said exhaust A/F ratio to a target A/F ratio range, and adjusts said first and second quantities if said exhaust A/F ratio is outside of said target A/F ratio range.

11. A method of operating a combustion engine comprising:

supplying liquid fuel having a first A/F ratio to said engine during cold start-up;

supplying liquid fuel at a second A/F ratio and vapor fuel at a third A/F ratio to said engine for a predetermined period after cold start-up; and determining said predetermined period based on a temperature of said engine.

12. The method of claim 11 wherein said temperature is an intake manifold temperature.

13. The method of claim 11 wherein said temperature is an intake valve temperature.

14. The method of claim 11 further comprising calculating said third A/F ratio based on said first A/F ratio.

15. The method of claim 11 further comprising:

determining an available A/F ratio of vapor fuel within a fuel tank; and comparing said available A/F ratio with a target A/F ratio range, wherein said third mass is zero if said available A/F ratio is outside of said target A/F ratio range.

16. The method of claim 15 further comprising adjusting said available A/F ratio based on an A/F ratio offset.

17. The method of claim 11 further comprising controlling a valve in communication with a supply of vapor fuel to regulate said vapor fuel.

18. The method of claim 11 further comprising:

comparing an exhaust A/F ratio to a target A/F ratio; and adjusting flow of said liquid fuel and said vapor fuel if said exhaust A/F ratio is not equal to said target A/F ratio.

19. The method of claim 18 further comprising:

determining an A/F ratio offset based on said exhaust A/F ratio and said target A/F ratio;

storing said A/F ratio offset; and adjusting said third A/F ratio based on said A/F ratio offset.

20. A method of operating a combustion engine comprising:

determining whether a temperature of said engine is within a specified range for cold start-up;

determining a first A/F ratio of a first supply of liquid fuel;

determining a second A/F ratio of a second supply of vapor fuel based on said first A/F ratio; and supplying said first supply of liquid fuel and said second supply of vapor fuel to said engine during a predetermined period after cold start-up.

21. The method of claim 20 wherein said temperature is an intake manifold temperature.

22. The method of claim 20 wherein said temperature is an intake valve temperature.

23. The method of claim 20 further comprising:

determining a third A/F ratio of a third supply of liquid fuel supplied to said engine during starting; and calculating said second A/F ratio based on said third A/F ratio.

24. The method of claim 20 further comprising:

determining an available A/F ratio of vapor fuel within a fuel tank; and comparing said available A/F ratio with a target A/F ratio range, wherein said second supply is zero if said available A/F ratio is outside of said target A/F ratio range.

25. The method of claim 24 further comprising adjusting said available A/F ratio based on an A/F ratio offset.

26. The method of claim 20 further comprising controlling a valve in communication with a supply of vapor fuel to regulate said second supply of vapor fuel.

27. The method of claim 20 further comprising:

comparing an exhaust A/F ratio to a target A/F ratio; and adjusting said first supply and second supply if said exhaust A/F ratio is not equal to said target A/F ratio.

28. The method of claim 27 further comprising:

determining an A/F ratio offset based on said exhaust A/F ratio and said target A/F ratio;

storing said A/F ratio offset; and adjusting said third A/F ratio based on said A/F ratio offset.

* * * * *